US011180341B2

(12) United States Patent
Brakensiek et al.

(10) Patent No.: US 11,180,341 B2
(45) Date of Patent: Nov. 23, 2021

(54) TEXTILE MACHINE PRODUCING CROSS-WOUND PACKAGES

(71) Applicant: Saurer Spinning Solutions GmbH & Co. KG, Uebach-Palenberg (DE)

(72) Inventors: Dirk Brakensiek, Neuss (DE); Elisabeth Klaczynski, Erkelenz (DE); Tai Mac, Würselen (DE); Erwin Peters, Düren (DE); Eduard Prediger, Mönchengladbach (DE); Philipp Schiffers, Erkelenz (DE); Michael Spitzer, Monschau-Kalterherberg (DE); Detlef Schelter, Erkelenz (DE); Heiko Toepke, Baesweiler (DE); Lothar Winzen, Herzogenrath (DE); Lothar Uedinger, Mönchengladbach (DE); Harald Wilhelm Wassen, Schwalmtal (DE)

(73) Assignee: Saurer Spinning Solutions GmbH & Co. KG, Uebach-Palenberg (DE)

( * ) Notice: Subject to any disclaimer, the term of this patent is extended or adjusted under 35 U.S.C. 154(b) by 62 days.

(21) Appl. No.: 16/710,723

(22) Filed: Dec. 11, 2019

(65) Prior Publication Data

US 2020/0180900 A1 Jun. 11, 2020

(30) Foreign Application Priority Data

Dec. 11, 2018 (DE) ..... 10 2018 131 767.0

(51) Int. Cl.
*B65H 54/06* (2006.01)
*D01H 4/02* (2006.01)
*B65H 54/26* (2006.01)

(52) U.S. Cl.
CPC ..... *B65H 54/06* (2013.01); *B65H 54/26* (2013.01); *D01H 4/02* (2013.01)

(58) Field of Classification Search
CPC ..... B65H 54/06; B65H 54/26; B65H 54/707; D01H 4/02; D01H 4/08
See application file for complete search history.

(56) References Cited

U.S. PATENT DOCUMENTS 2,946,174 A * 7/1960 Bahnson, Jr. ..... D01H 11/005 57/304
3,018,503 A * 1/1962 Okawa ..... D01H 11/006 15/312.1

(Continued)

FOREIGN PATENT DOCUMENTS

DE 38 10 588 A1 10/1989
DE 10 2004 016 797 A1 10/2005

(Continued)

*Primary Examiner* — Shaun R Hurley
(74) *Attorney, Agent, or Firm* — Nelson Mullins Riley & Scarborough LLP

(57) ABSTRACT

A textile machine for producing cross-wound packages, comprising a plurality of workstations, each of which has at least one pneumatic consumer, and comprising a suction system which has at least one vacuum source to which the pneumatic consumers of the workstations are connected via a machine-length vacuum duct arranged in the region of the central axis between two rows of workstations. In order to modify such a textile machine producing cross-wound packages in such a way that it is ensured that the required minimum spinning vacuum is always available at all workstations of the textile machine during spinning operation, according to the invention the textile machine producing cross-wound packages has, in addition to the vacuum duct, a machine-length bypass duct which is also installed in the region of the central axis and is arranged above chain ducts for service units.

7 Claims, 3 Drawing Sheets

(56) References Cited

U.S. PATENT DOCUMENTS

| | | | | | |
|---|---|---|---|---|---|
| 3,070,320 | A * | 12/1962 | Reiners | B65H 54/26 | 242/474 |
| 3,998,039 | A * | 12/1976 | Furstenberg | D01H 4/08 | 57/403 |
| 4,255,925 | A * | 3/1981 | Marzoli | D01H 1/16 | 57/1 R |
| 4,432,200 | A * | 2/1984 | Bischofberger | D01H 5/68 | 57/304 |
| 4,773,208 | A * | 9/1988 | Wolf | D01H 11/00 | 57/304 |
| 4,895,186 | A * | 1/1990 | Shaw | B65H 54/26 | 139/10 |
| 4,947,509 | A * | 8/1990 | Dinkelmann | D01H 11/005 | 15/301 |
| 5,484,116 | A * | 1/1996 | Horak | B65H 67/02 | 242/475.6 |
| 6,342,083 | B1 * | 1/2002 | Spitzer | B65H 54/702 | 19/200 |
| 2007/0175200 | A1 * | 8/2007 | Stahlecker | D01H 15/002 | 57/263 |
| 2016/0168764 | A1 * | 6/2016 | Bungter | B65H 63/00 | 362/89 |
| 2017/0350042 | A1 * | 12/2017 | Pohn | D01H 7/00 | |

FOREIGN PATENT DOCUMENTS

| | | | |
|---|---|---|---|
| DE | 10 2005 029 056 | A1 | 12/2006 |
| DE | 10 2007 053 467 | A1 | 5/2009 |
| DE | 10 2013 008 107 | A1 | 11/2014 |
| EP | 1 283 288 | B1 | 9/2005 |

* cited by examiner

TEXTILE MACHINE PRODUCING CROSS-WOUND PACKAGES

CROSS-REFERENCE TO RELATED APPLICATIONS

This application claims priority from German National Patent Application No, 10 2018 131 767.0, filed Dec. 11, 2018, entitled "Kreuzspulen herstellende Textilmaschine", the entire contents of which are incorporated herein by reference.

FIELD OF THE INVENTION

The invention concerns a textile machine producing cross-wound packages comprising a plurality of workstations, each of which has at least one pneumatic consumer, and comprising a suction system which has at least one vacuum source to which the pneumatic consumers of the workstations are connected via a machine-length vacuum duct arranged in the region of the central axis between two rows of workstations.

BACKGROUND OF THE INVENTION

As is well known, textile machines producing cross-wound packages, e.g. open-end rotor spinning machines, generally have a plurality of similar workstations arranged next to one another. The machine has a row of workstations both in the region of the machine front and in the region of the machine rear. The workstations are each equipped with an open-end rotor spinning device and a winding device, among other things, and always require a so-called minimum spinning vacuum for proper spinning operation.

At such workstations, the open-end rotor spinning device spins a fibre band, which is provided in a spinning can for example, into a thread, which is then wound into a cross-wound package by means of the winding device.

Such open-end rotor spinning devices, as described in DE 10 2013 008 107 A1 for example, each have an opening roller, which is rotatably mounted in an opening roller housing and combs out the presented fibre band into individual fibres, and a spinning rotor rotating at high speed in a rotor housing subjected to a vacuum, The opening roller housing is connected to the rotor housing via a so-called fibre guide channel, which in turn is connected via a vacuum connection to a machine-length vacuum duct and thus to a vacuum source. This means that the vacuum initiated by the vacuum source leads to flow conditions within the open-end rotor spinning device which ensure pneumatic transport of the individual fibres from the opening roller to the spinning rotor, in which case the individual fibres are spun into a thread which is then wound onto a cross-wound package.

At such workstations, the finished cross-wound packages are usually transferred to a machine-length cross-wound package transport apparatus by automatic service units that can be moved along the rows of workstations. Afterwards, the workstations are pieced up again by the service units. Such service units also intervene when a spinning interruption has occurred at a workstation, for example due to a thread break.

EP 1 283 288 B1 also discloses open-end rotor spinning machines having workstations that are designed as so-called autonomous workstations. This means that the workstations of these textile machines are designed in such a way that they not only spin a thread out of a presented fibre band, said thread then being wound onto a cross-wound package, but such workstations are also capable of transferring a finished cross-wound package to a machine-length cross-wound package transport apparatus and of piecing it up again independently after a spinning interruption.

Such autonomous workstations have, among other things, a pivotally mounted suction nozzle which can be subjected to vacuum and which can be adjusted in a defined manner, for example by means of a stepper motor, between a thread-end pick-up position and a thread-end transfer position.

For example, the suction nozzle picks up a thread end that has run onto the surface of the cross-wound package after a thread break and transfers it to a piecing tool positioned in the region of the open-end rotor spinning device. Such workstations usually also have a pneumatically actuated accumulator nozzle which temporarily stores the excess thread during the run-up of the workstations, preferably in the form of a thread loop.

Open-end rotor spinning machines equipped with autonomous workstations are characterised by high flexibility and relatively high overall efficiency. However, in such textile machines the air consumption of the workstations is relatively high, especially during the piecing process, due to the required spinning vacuum, the suction nozzle subjected to vacuum and the pneumatic accumulator nozzle. It is therefore often the case with textile machines producing cross-wound packages of this type that the number of workstations that can be pieced up at the same time is limited. Depending on the configuration, the number of workstations can be limited, for example, to 12 or 24 workstations.

As indicated above, however, even workstations that are supplied by automatically operating service units always require a certain minimum spinning vacuum in the region of all workstations during spinning operation, which is usually provided by a suction system belonging to the machine. This means that, regardless of the respective configurations of the workstations, the required spinning vacuum is usually provided in textile machines producing cross-wound packages by a suction system belonging to the machine, which has at least one vacuum source and a machine-length vacuum duct.

In the case of very long textile machines, however, relatively large fluidic pressure losses often occur within the machine-length vacuum duct, which can have a negative effect, especially at workstations which are relatively far away from the vacuum source, because an adequate vacuum supply is often not guaranteed at these workstations.

Various proposals have therefore been made in the past to address this problem.

In DE 10 2007 053 467 A1, for example, it was proposed to connect the machine-length vacuum duct of the textile machine to a plurality of relatively powerful vacuum sources, which can be switched on as required. The vacuum sources are arranged in a machine frame at the end of the textile machine and the cross-section of the vacuum duct is as large as possible. However, the size of the cross-section of the vacuum duct is limited by the design of the textile machine producing cross-wound packages.

DE 10 2004 016 797 A1 describes an open-end rotor spinning machine, the vacuum supply of which is divided into two line apparatuses separated from one another in a leak-tight manner and which are connected to a vacuum source at the end of the machine. This means that a first line apparatus supplies a vacuum to the workstations arranged in the input region of the open-end rotor spinning machine, while the workstations arranged on the output side of the machine are connected to a second line apparatus.

A comparable apparatus is also described in DE 38 10 588 A1 in connection with a very long ring spinning machine.

Even in this known textile machine, which has a very large number of workstations, each of which is equipped with at least one pneumatic consumer, the apparatus is divided into pneumatically separated duct portions connected to a common vacuum source in order to ensure a sufficient vacuum supply to all workstations.

In addition, DE 10 2005 029 056 A1 discloses an open-end rotor spinning machine, which, as is usual, is equipped with an apparatus for providing the vacuum required at the workstations during spinning.

The apparatus for generating a vacuum has a vacuum source arranged in a machine frame of the spinning machine, which is positioned between the workstations of the spinning machine in such a way that the number of workstations on each side of the machine frame is at least 40% of the total number of workstations. Such an arrangement of the vacuum source means that the length of the vacuum ducts is approximately halved, i.e. due to the approximately central arrangement of the machine frame and thus of the vacuum source, the length of the vacuum ducts is significantly shortened, and the necessary spinning vacuum is distributed along this length to the workstations, thereby leading to a significant reduction in the pressure losses in the vacuum ducts.

Proceeding from the aforementioned state of the art, the problem addressed by the invention is that of modifying a textile machine producing cross-wound packages, which comprises a plurality of workstations, each of which has at least one pneumatic consumer, and comprises a suction system for providing a spinning vacuum, and in which the vacuum source of the suction system, which is arranged in an end frame of the textile machine and connected to the pneumatic consumers of the workstations via a machine-length vacuum duct, in such a way that it is always ensured that the required minimum spinning vacuum is always available at all workstations of the textile machine during spinning operation.

This problem is solved according to the invention in that the textile machine producing cross-wound packages has, in addition to the vacuum duct, a machine-length bypass duct, which is also installed in the region of the central axis between two rows of workstations and is arranged above chain ducts for service units.

The dependent claims relate to advantageous configurations of the invention.

The bypass duct positioning according to the invention has the particular advantage that, despite the relatively limited installation space available in the region of an open-end rotor spinning machine, the unavoidable flow losses occurring in the machine-length vacuum duct can be largely compensated for. This means that the pressure losses occurring in the machine-length vacuum duct, which without appropriate countermeasures would lead to a deficiency in the vacuum supply, in particular of the workstations located far away from the vacuum source, are compensated for by the arrangement of an additional, parallel bypass duct. The invention also makes it possible to arrange the bypass duct without increasing the installation space of the textile machine. The available space between the rows of workstations is utilised. It is not necessary to increase the overall height of the textile machine either. The chain ducts guide drag chains having lines for supplying mobile service units. Due to their design, the service units protrude beyond the chain ducts. The bypass duct does not have to extend beyond the upper edge of the service units. In this way, the existing installation space is optimally utilised.

In an advantageous embodiment, the machine-length bypass duct connected to the vacuum source is connected to the vacuum duct at the region of the textile machine opposite the vacuum source, Such an arrangement ensures that the additional vacuum provided via the bypass duct is effective directly in the region of the workstations that would be most severely affected by a lack of vacuum without countermeasures. This means that by arranging the bypass duct in this way, it is relatively simple to ensure that the workstations located far away from the vacuum source are always sufficiently supplied with vacuum.

An advantageous embodiment results when the bypass duct is mounted on a frame apparatus that is arranged between the chain ducts and has pipe holders for the bypass duct. Such a design not only ensures that sufficient vacuum can always be transferred to the affected machine region through the bypass duct despite limited spatial conditions, but also that the operation of the open-end rotor spinning machine, in particular the operation of the service units patrolling the textile machine, is not impeded in any way.

In a further advantageous embodiment, the vacuum duct has a cross-section that is at least partly rectangular, while the bypass duct has a circular cross-section. The space available in the region of the central axis of the textile machine is utilised to the maximum extent by the at least partly rectangular cross-section of the vacuum duct, i.e. a strong, relatively uniform vacuum flow can be initiated in such a vacuum duct.

In addition, the circular cross-section of the bypass duct ensures that the wall area of the bypass duct touched by the vacuum flow is as small as possible and thus the unavoidable flow losses are minimised.

Further details of the invention can be taken from the embodiment example explained below on the basis of the drawings.

DESCRIPTION OF THE DRAWINGS

FIG. 1 is a side view of a textile machine producing cross-wound packages, in the embodiment example an open-end rotor spinning machine 1, which has a plurality of similar workstations 2 arranged next to one another. This means that such open-end rotor spinning machines 1 each have a plurality of identically designed workstations 2 arranged in a row both in the region of their machine front and in the region of their machine rear. The two rows of workstations are positioned in a mirror-image arrangement in relation to the central axis 17.

Figure 1:
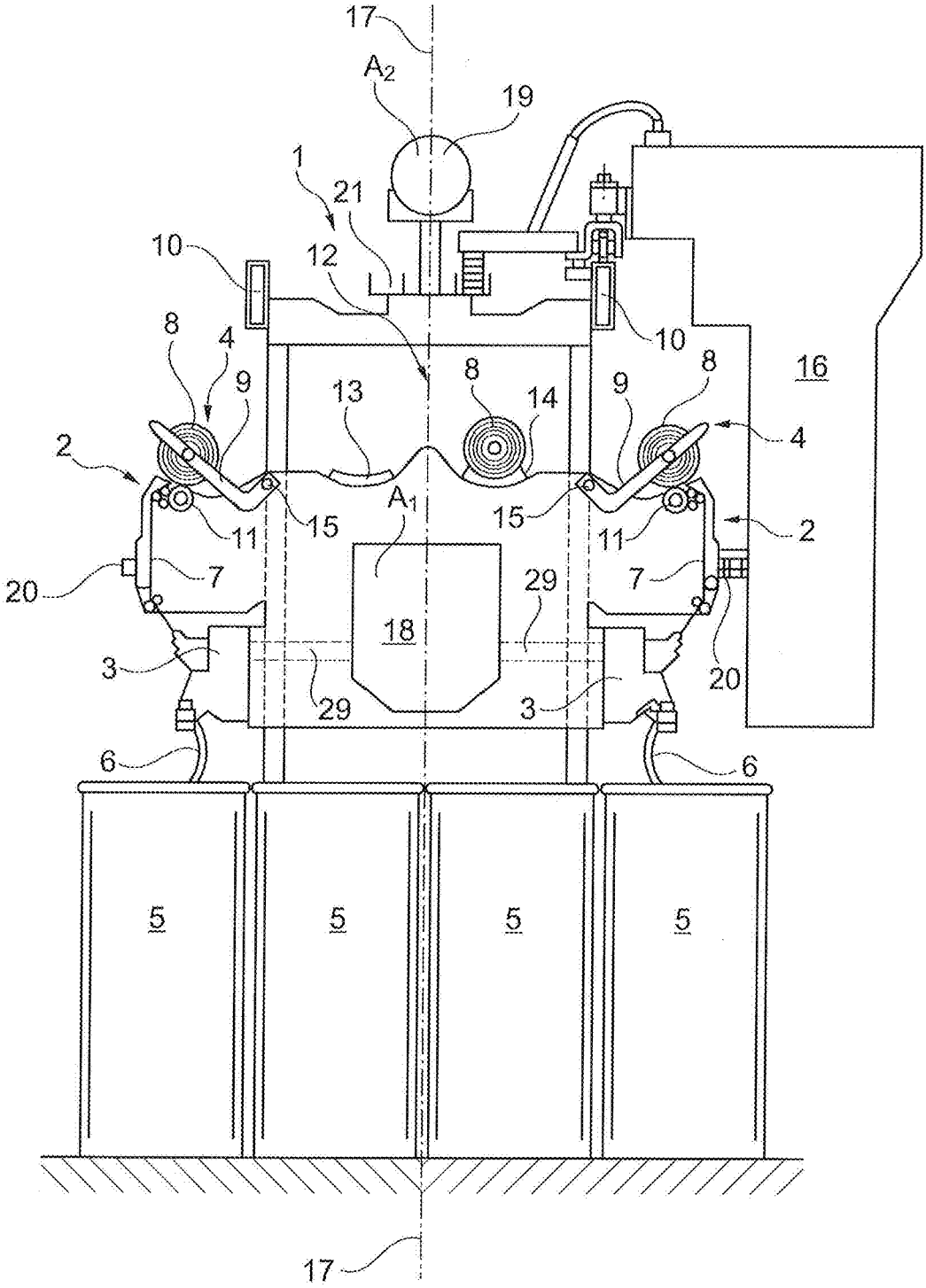
FIG. 1 is a side view of a textile machine producing cross-wound packages in the form of an open-end rotor spinning machine comprising a suction system for supplying the workstations with spinning vacuum, said system having a machine-length vacuum duct and a bypass duct.

As is known, the workstations 2 of such textile machines 1 generally each have an open-end rotor spinning device 3 and a winding device 4. By means of the open-end rotor spinning device 3, which is configured as a pneumatic consumer, a fibre band 6 stored in a spinning can 5 is spun into a thread 7, which is then wound into a cross-wound package 8 on the winding device 4.

Figure 2:
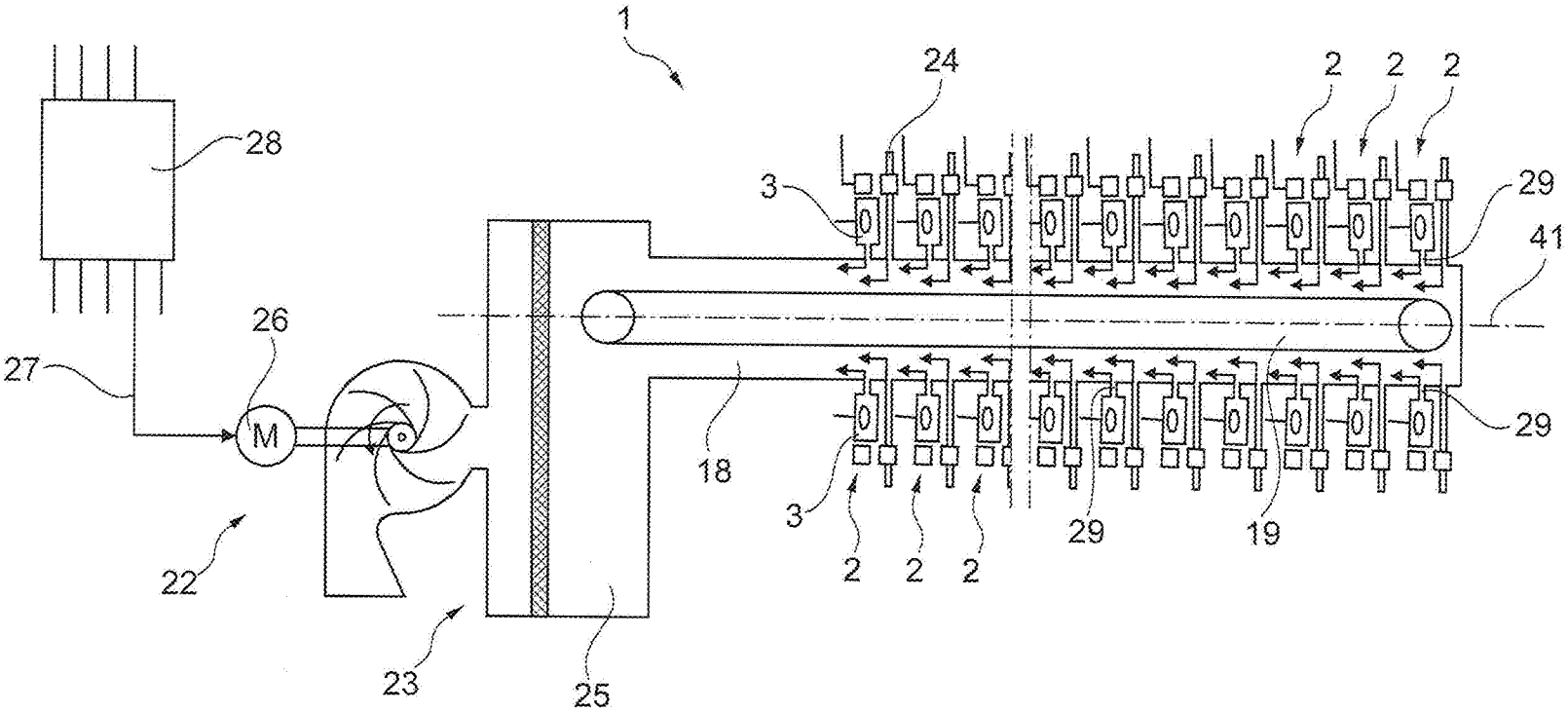
FIG. 2 is a schematic plan view of a suction system designed according to the invention for supplying the pneumatic consumers at the workstations of a textile machine producing cross-wound packages.

As indicated in FIG. 1, the open-end rotor spinning devices 3 of the workstations 2 are each connected via a vacuum connection 29 to a machine-length vacuum duct 18, which is arranged in the region of the central axis 17 of the textile machine 1 and is a component of a suction system 23 belonging to the machine. As shown in FIG. 2, the vacuum duct 18 is connected to a filter chamber 25 upon which a vacuum source 22 acts pneumatically. This means that the open-end rotor spinning devices 3 are supplied with spinning vacuum by the vacuum source 22 via the vacuum duct 18 and the vacuum connections 29 during spinning operation.

For their part, the winding devices 4 each have a package cradle 9 for rotatably mounting a cross-wound package tube and, in this embodiment example, a winding roller 11 for the frictionless driving of a cross-wound package 8 and the simultaneous traversing of the running thread 7. In this case, the package cradle 9 is rotatably mounted in a restricted manner about a pivot axis 15.

As can also be seen, a cross-wound package transport apparatus 12 is arranged between the two rows of workstations and is formed, for example, by two conveyor belts 13, 14 running in parallel. The cross-wound package transport apparatus 12 transports away cross-wound packages 8 which have reached a predeterminable diameter. This means that service units 16, e.g. so-called package doffers, can be moved on corresponding rails 10 or 20 of the open-end rotor spinning machine 1 and patrol along the workstations 2 of the open-end rotor spinning machine 1 during spinning operation. The service units 16 intervene automatically if action is required at one of the workstations 2.

Such a need for action arises, for example, if the cross-wound package 8 has reached its prescribed diameter at one the workstations 2 and has to be exchanged for a new cross-wound package tube. In this case, the package doffer 16 positions itself in front of the relevant workstation 2 and transfers the full cross-wound package 8 from the package cradle 9 of the winding device 4 of the relevant workstation 2 onto an associated conveyor belt 13 or 14 of the cross-wound package transport apparatus 12, the conveyor belt being positioned behind the workstation 2. Next, the service unit 16 swaps a new cross-wound package tube into the package cradle 9, such that the spinning and winding process can be restarted on the relevant workstation 2.

Since open-end rotor spinning devices 3, as described above, always require a certain minimum spinning vacuum during spinning operation and, if no corresponding measures are taken, the vacuum in the vacuum duct 18 gradually decreases with increasing distance from the vacuum source 22, the suction system 23 of the open-end rotor spinning machine 1 is equipped with a bypass duct 19 in addition to the vacuum duct 18. This means that the open-end rotor spinning machine 1 has, in addition to a machine-length vacuum duct 18, which is preferably at least partly rectangular in cross-section, a further, likewise machine-length bypass, duct 19. This bypass duct 19, which is preferably round in cross-section, is advantageously arranged above the chain ducts 21 for the service unit 16 and, as shown in FIG. 2, is connected to the vacuum duct 18 on the side of the textile machine 1 opposite the vacuum source 22.

As shown in FIG. 2, the vacuum duct 18 and the bypass duct 19 extend along a machine longitudinal axis 41. Both ducts are each connected to a filter chamber 25, which can be subjected to a vacuum by at least one vacuum source 22. This means that the vacuum source 22 is driven by a variable-speed electric motor 26, which is connected to the central control unit 28 of the open-end rotor spinning machine 1 via a control line 27. The bypass duct 19 is also connected to the vacuum duct 18 on the side of the textile machine 1 opposite the filter chamber 25. As is usual, pneumatic consumers are connected to the vacuum duct 18 in the region of the workstations 2. This means that an open-end rotor spinning device 3 is connected in the region of workstations 2, in each case via a vacuum connection 29.

However, further pneumatic consumers can be installed in the region of the workstations 2. The workstations 2 can, for example, each be equipped with a thread accumulator nozzle 24.

Figure 3:
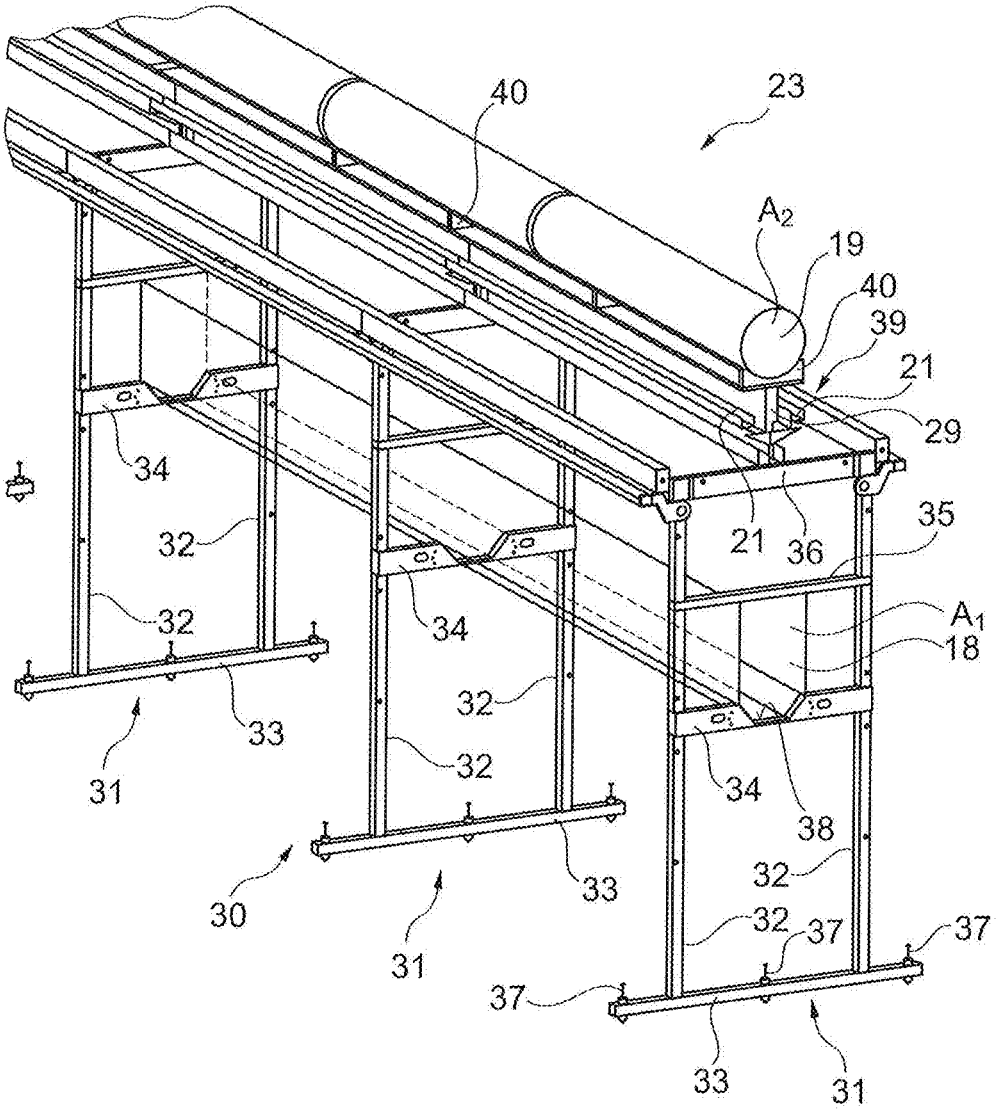
FIG. 3 is a perspective view of a portion of a suction system configured according to the invention, having a machine-length vacuum duct, which is at least partly angular in cross-section, and a bypass duct, which is round in cross-section and is arranged between the workstations in the region of the central longitudinal axis of an open-end rotor spinning machine.

FIG. 3 is a perspective view of a portion of a suction system 23 of an open-end rotor spinning machine 1.

The suction system 23 configured according to the invention has a machine-length vacuum duct 18, which is at least partly angular in cross-section, and a bypass duct 19, which is round in cross-section. The vacuum duct 18 and the bypass duct 19 are arranged in the region of the central axis 17 of the open-end rotor spinning machine 1 between the rows of workstations.

As can be seen, such open-end rotor spinning machines 1 have a central supporting structure 30 consisting of frame components 31, to which the open-end rotor spinning devices 3 and the winding devices 4 of the numerous workstations 2, among other things, are attached.

The individual frame components 31 of this supporting structure 30 each consist of two vertically arranged supports 32, which are connected by various cross-beams 33-36, preferably by welding. The lower cross-beam 33 forms a base element, which has adjustment apparatuses 37 which enable the frame component 31 to be aligned exactly even on uneven ground.

The vacuum duct 18 is fastened between the two middle cross-beams 34, 35, the cross-beam 34 having a recess 38 for the vacuum duct 18 and the cross-beam 35 forming the basis for a cross-wound package transport apparatus 12 (not shown in FIG. 3).

The upper cross-beam 36 serves, among other things, as a support for the chain ducts 21 of the service units 16. Between the chain ducts 21 a frame apparatus 39 for the bypass duct 19 is also installed, said frame apparatus in turn consisting of vertical beams, horizontal plates and pipe holders 40. The round bypass duct 19 is positioned in the pipe holders 40 in such a way that, on the one hand, the existing installation space is optimally utilised for the installation of said duct and, on the other hand, the operation of the service units 16 is not obstructed in any way.

The concept of the invention is not limited to the embodiment example described above. In the context of the present invention, it is only essential that an additional bypass duct 19, the installation of which makes optimum use of the limited installation space, ensures that there is always an appropriate spinning vacuum at all workstations 2.

LIST OF REFERENCE SIGNS

1 Open-end rotor spinning machine
2 Workstation
3 Open-end rotor spinning device
4 Winding device

5 Spinning can
6 Fibre band
7 Thread
8 Cross-wound package
9 Package cradle
10 Rail
11 Winding roller
12 Cross-wound package transport apparatus
13 Conveyor belt
14 Conveyor belt
15 Pivot axis
16 Service unit
17 Central axis
18 Vacuum duct
19 Bypass duct
20 Rail
21 Chain duct
22 Vacuum source
23 Suction system
24 Thread accumulator nozzle
25 Filter chamber
26 Electric motor
27 Control line
28 Central control unit
29 Vacuum connection
30 Supporting structure
31 Frame component
32 Support
33 Cross-beam
34 Cross-beam
35 Cross-beam
36 Cross-beam
37 Adjustment apparatus
38 Recess
39 Frame apparatus
40 Pipe holder
41 Machine longitudinal axis
$A_1$ Cross-section of the vacuum duct
$A_2$ Cross-section of the bypass duct

What is claimed is:

1. A textile machine for producing cross-wound packages, comprising a plurality of workstations, each of which has at least one pneumatic consumer, and comprising a suction system which has at least one vacuum source to which the pneumatic consumers of the workstations are connected via a machine-length vacuum duct arranged in the region of the central axis between two rows of workstations, characterised in that the textile machine producing cross-wound packages has, in addition to the vacuum duct, a machine-length bypass duct, which is installed in the region of the central axis and is arranged above chain ducts for service units.

2. The textile machine for producing cross-wound packages according to claim 1, characterised in that the bypass duct connected to the vacuum source is connected to the vacuum duct at the region of the textile machine opposite the vacuum source.

3. The textile machine for producing cross-wound packages according to claim 1, characterised in that the bypass duct is mounted on a frame apparatus arranged between the chain ducts.

4. The textile machine for producing cross-wound packages according to claim 2, characterised in that the bypass duct is mounted on a frame apparatus arranged between the chain ducts.

5. The textile machine for producing cross-wound packages according to claim 3, characterised in that the frame apparatus has pipe holders for mounting the bypass duct.

6. The textile machine for producing cross-wound packages according to claim 1, characterised in that the vacuum duct has a cross-section that is rectangular.

7. The textile machine for producing cross-wound packages according to claim 1, characterised in that the bypass duct has a circular cross-section.

* * * * *